US009070996B2

(12) United States Patent
Kobayashi et al.

(10) Patent No.: US 9,070,996 B2
(45) Date of Patent: Jun. 30, 2015

(54) CONNECTOR

(71) Applicant: YAZAKI CORPORATION, Tokyo (JP)

(72) Inventors: Tohru Kobayashi, Makinohara (JP); Shoji Yamamoto, Fujieda (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/734,299

(22) Filed: Jan. 4, 2013

(65) Prior Publication Data

US 2013/0122728 A1 May 16, 2013

Related U.S. Application Data

(63) Continuation of application No. PCT/JP2011/066773, filed on Jul. 15, 2011.

(30) Foreign Application Priority Data

Jul. 20, 2010 (JP) ..... 2010-162458

(51) Int. Cl.

| | |
|---|---|
| ***H01R 13/44*** | (2006.01) |
| ***H01R 13/447*** | (2006.01) |
| ***H01R 13/52*** | (2006.01) |
| ***H01R 13/58*** | (2006.01) |
| *H01R 13/629* | (2006.01) |

(52) U.S. Cl.

CPC ..... *H01R 13/447* (2013.01); *H01R 13/5213* (2013.01); *H01R 13/5812* (2013.01); *H01R 13/5837* (2013.01); *H01R 13/62938* (2013.01)

(58) Field of Classification Search

USPC ..... 439/136, 471, 452, 157, 460, 470

See application file for complete search history.

(56) References Cited

U.S. PATENT DOCUMENTS

| | | | | |
|---|---|---|---|---|
| 3,603,913 | A * | 9/1971 | Hasty, Jr. | 439/471 |
| 3,638,169 | A * | 1/1972 | Caveney et al. | 439/471 |
| 3,732,526 | A * | 5/1973 | Punako | 439/471 |

(Continued)

FOREIGN PATENT DOCUMENTS

| | | | |
|---|---|---|---|
| CN | 1198032 | A | 11/1998 |
| JP | UM-A-S49-143785 | A | 8/1972 |

(Continued)

OTHER PUBLICATIONS

International Search Report dated Oct. 21, 2011 issued in International Application No. PCT/JP2011/066773 (PCT/SA/210).

(Continued)

*Primary Examiner* — Jean F Duverne
(74) *Attorney, Agent, or Firm* — Sughrue Mion, PLLC

(57) ABSTRACT

In a connector, a flange portion is provided at an end portion of an electric wire fixing portion. A rib is provided on outer surface of the electric wire fixing portion. A biding band winding space is provided between an end of the rib and the flange portion. An interval therebetween has a width equal to a width of the binding band. The electric wire is fixed by the binding band wound on the binding band winding space. A band passing hole is formed between the end of the rib and the flange portion. A plurality of side ribs are symmetrically provided at both sides of the rib. The binding band is inserted through the band passing hole, in response to a volume of the electric wire or in response to a size of a radius of curvature of the electric wire led out from the connector housing.

11 Claims, 7 Drawing Sheets

(56) References Cited

U.S. PATENT DOCUMENTS

| | | | | |
|---|---|---|---|---|
| 3,792,417 | A | 2/1974 | Punako | |
| 5,074,805 | A * | 12/1991 | Kirma | 439/452 |
| 5,192,224 | A * | 3/1993 | Bernardini | 439/471 |
| 6,056,587 | A | 5/2000 | Matsuoka et al. | |
| 6,762,363 | B2 * | 7/2004 | Yamashita et al. | 174/74 R |
| 7,618,280 | B2 * | 11/2009 | Horst | 439/460 |
| 2002/0170736 | A1 | 11/2002 | Yamashita et al. | |
| 2008/0303272 | A1 | 12/2008 | Takahashi et al. | |

FOREIGN PATENT DOCUMENTS

| | | | |
|---|---|---|---|
| JP | 2002-343497 | A | 11/2002 |
| JP | 2008305612 | A | 12/2008 |
| JP | 2010-34018 | A | 2/2010 |
| JP | 2010-55893 | A | 3/2010 |
| JP | 201055863 | A | 3/2010 |
| WO | 2009048546 | A1 | 4/2009 |

OTHER PUBLICATIONS

Written Opinion dated Oct. 21, 2011 issued in International Application No. PCT/JP2011/066773 (PCT/SA/237).

Japanese Office Action; Application No. 2010-162458; issued Jul. 11, 2014.

Office Action, Issued by the State Intellectual Property Office of P.R. China, Dated Dec. 9, 2014, In counterpart Chinese Application No. 201180035717.4.

* cited by examiner

CONNECTOR

TECHNICAL FIELD

The present invention is related to a connector equipped with a cover, that covers and protects electric wires which are pulled out from a connector housing containing terminals connected to end portions of the electric wires correspondingly, and guides the electric wires to lead them to an outside.

BACKGROUND ART

As the connector with a cover, there is the connector as shown in FIG. 7 (see PTL 1).

A connector 100 shown in FIG. 7 includes a connector housing 104 that contains terminals 103 that are connected to one end portions 102 of electric wires 101 correspondingly therein. A cover 105 for leading the electric wires 101, which are pulled out from the connector housing 104, to the outside while guiding the electric wires is attached to the connector housing 104. Also, a lever 106 is attached to the cover 105 so as to straddle in a width direction of the cover 105.

A flange portion 111 is formed on an electric wire leading port of the cover 105, from which the electric wires 101 are led toward the outside. Also, an electric wire fixing portion 109, in which the electric wires 101 are fastened and fixed by a binding band 108 and which has an almost gate-shaped section, is provided at the electric wire leading port so as to protrude outward. Also, a pair of band passing holes 110, through which the binding band 108 is passed respectively, are formed at corner portions on both sides of the electric wire fixing portion 109.

Also, the electric wire fixing portion 109 is configured so that the binding band 108 for binding the electric wires 101 can be wound thereon. A pair of retaining projections 113 are provided at the end of the electric wire fixing portion 109 at the electric wires 101 leading side such that the projections 113 protrude outward from rear bottom ends of both side walls 112 of the electric wire fixing portion 109. The pair of retaining projections 113 prevent the wounded binding band 108 being slipped off.

That is, when the binding band 108 is wound on the electric wire fixing portion 109 without passing through the band passing hole 110, the binding band 108 wound on the electric wire fixing portion 109 is prevented being slipped off by the flange portion 111 and the projections 113.

CITATION LIST

Patent Literature

[PTL 1] JP-A-2002-343497
[PTL 2] JP-A-2010-55863
[PTL 3] JP-A-2010-34018

SUMMARY OF INVENTION

Technical Problem

However, in the conventional connector 100, when the binding band 108 is wound on the electric wire fixing portion 109 without passing through the band passing hole 110, a distance between the flange portion 111 and the projections 113 is larger than a width of the binding band 108 wound on the electric wire fixing portion 109. Therefore, the binding band 108 is moved between the flange portion 111 and the projections 113. As a result, such a problem exists that the electric wires 101 may be damaged by the binding band 108.

Also, in the conventional connector 100, two band passing holes 110 are still formed in the electric wire fixing portion 109. In a case where the binding band 108 is wound on the electric wire fixing portion 109 without passing through the band passing hole 110, when the electric wire fixing portion 109 is fastened excessively by the binding band 108, the cover 105 is deformed. As a result, such a problem arises that the electric wires 101 are fastened excessively tightly.

In PTLs 2 and 3, the reinforcing rib is provided to the connector 100. Nevertheless, the binding band 108 wound on the electric wire fixing portion 109 is moved between the flange portion 111 and the projections 113. As a result, the problem that the electric wires 101 may be damaged by the binding band 108 is not led to a solution.

It is therefore one advantageous aspect of the present invention to provide a connector that is able to bind selectively electric wires freely in response to a volume of the bound number of electric wires or in response to a size of a radius of curvature of the electric wires that are to be arranged to curve, such that a movement of the binding band wound on an electric wire fixing portion is not caused even in the situation that the binding band is wound on the electric wire fixing portion without pass through a band passing hole.

Solution to Problem

According to one advantage of the invention, there is provided a connector, comprising:

a connector housing, configured to accommodate a terminal connected to an end of an electric wire;

a cover, attached to the connector housing, and configured to lead the electric wire from the connector housing to an outside;

an electric wire fixing portion, provided at an electric wire leading port formed in the cover where the electric wire is led out;

a flange portion, provided at an end portion of the electric wire fixing portion where the electric wire is pulled out from the connector housing;

a rib, provided on outer surface of the electric wire fixing portion, extending in a longitudinal direction of the electric wire fixing portion at a center thereof;

a biding band winding space, provided between an end of the rib and the flange portion, an interval therebetween having a width equal to a width of a binding band, wherein the electric wire is fixed by the binding band wound on the binding band winding space;

a band passing hole, formed between the end of the rib and the flange portion, configured so that the binding band is inserted therethrough; and a plurality of side ribs, symmetrically provided at both sides of the rib, wherein, when the electric wire is fixed in the electric wire fixing portion by the binding band, the binding band is inserted through the band passing hole, in response to a volume of the electric wire or in response to a size of a radius of curvature of the electric wire led out from the connector housing.

The band passing hole may be a slit extending in the longitudinal direction of the electric wire fixing portion.

The rib and the flange may be configured to restrict a movement of the binding band in the longitudinal direction of the electric wire fixing portion.

Advantages Effects of Invention

According to the present invention, even when the binding band is wound on the electric wire fixing portion without passing through the band passing hole, the electric wires can be bound freely selectively in response to a volume of the bound number of electric wires or in response to a size of a radius of curvature of the electric wires that are to be arranged to curve, such that a movement of the binding band being wound on the electric wire fixing portion is not caused.

Also, according to the present invention, a movement of the band can be restricted by an end portion of the rib that extends in the longitudinal direction of the electric wire.

According to the present invention, even when the electric wires are fastened excessively by the binding band in such a situation that the binding band is wound on the electric wire fixing portion without passing through the band passing hole, it can be prevented that deformation in shape of the cover is caused.

According to the present invention, the band passing hole is provided in the middle of the electric wire fixing portion like a slit shape in the longitudinal direction. Therefore, when the electric wires are to be bound by passing the binding band through the band passing hole, these electric wires can be bound by selecting freely whether or not the binding band is passed through the band passing hole, in response to a volume of the bound number of electric wires or in response to a size of a radius of curvature of the electric wires that are to be arranged to curve. As a result, it can be prevented that a movement of the binding band in the longitudinal direction of the electric wire fixing portion is caused after the electric wires are bound.

According to the present invention, when the binding band is wound on the electric wire fixing portion without passing through the band passing hole, it can be restricted by the rib and the flange portion that the binding band is moved in the longitudinal direction of the electric wire fixing portion. As a result, it can be prevented that the binding band is moved in the longitudinal direction of the electric wire fixing portion after the electric wires are bound by the binding band.

DESCRIPTION OF EMBODIMENTS

A connector as a subject of the present invention is equipped with a connector housing that contains the terminals connected to end portions of electric wires respectively. A cover for guiding the electric wires that are pulled out from the connector housing and leading them toward the outside is fitted to this connector housing. An electric wire fixing portion in which the electric wires are fastened and fixed by a binding band is provided to an electric wire leading port from which the electric wires in this cover are led to the outside. Also, a band passing hole through which the binding band is passed is formed in this electric wire fixing portion.

In the present invention, in the connector constructed in this manner, a flange portion is formed on an end portion of the electric wire fixing portion on the electric wire passing side. Ribs that are extended in the longitudinal direction of the electric wire fixing portion are formed on an outer peripheral surface of the electric wire fixing portion in the middle of the electric wire fixing portion. Also, a binding band winding space whose interval is set substantially equal to a width of the binding band is provided between ends of the ribs and the flange portion on the electric wire fixing portion.

Further, a band passing hole through which the binding band is passed is provided in the binding band winding space between ends of the ribs and the flange portion.

According to such configuration, when the electric wires are to be bound and fixed by the binding band in the electric wire fixing portion, the electric wires can be bound by the binding band, while selecting freely whether or not the binding band should be passed through the band passing hole to bind the electric wires or whether or not the binding band should not be passed through the band passing hole to bind the electric wires, in response to a volume of the bound number of electric wires or in response to a size of a radius of curvature of the electric wires that are to be arranged to curve.

Figure 1:
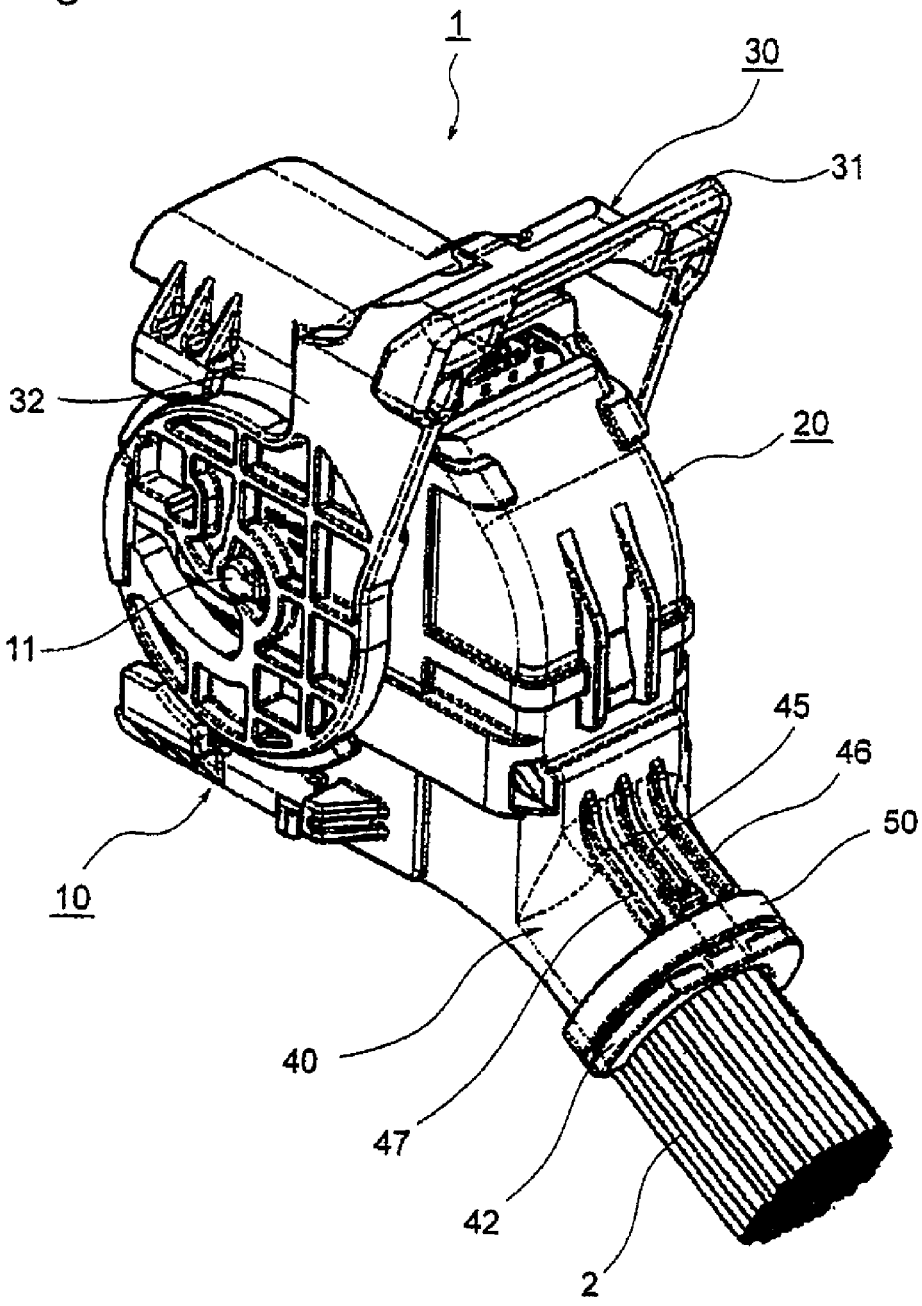
FIG. 1 is a perspective view showing a connector according to an embodiment of the present invention when viewed from the cover side.
Figure 2:
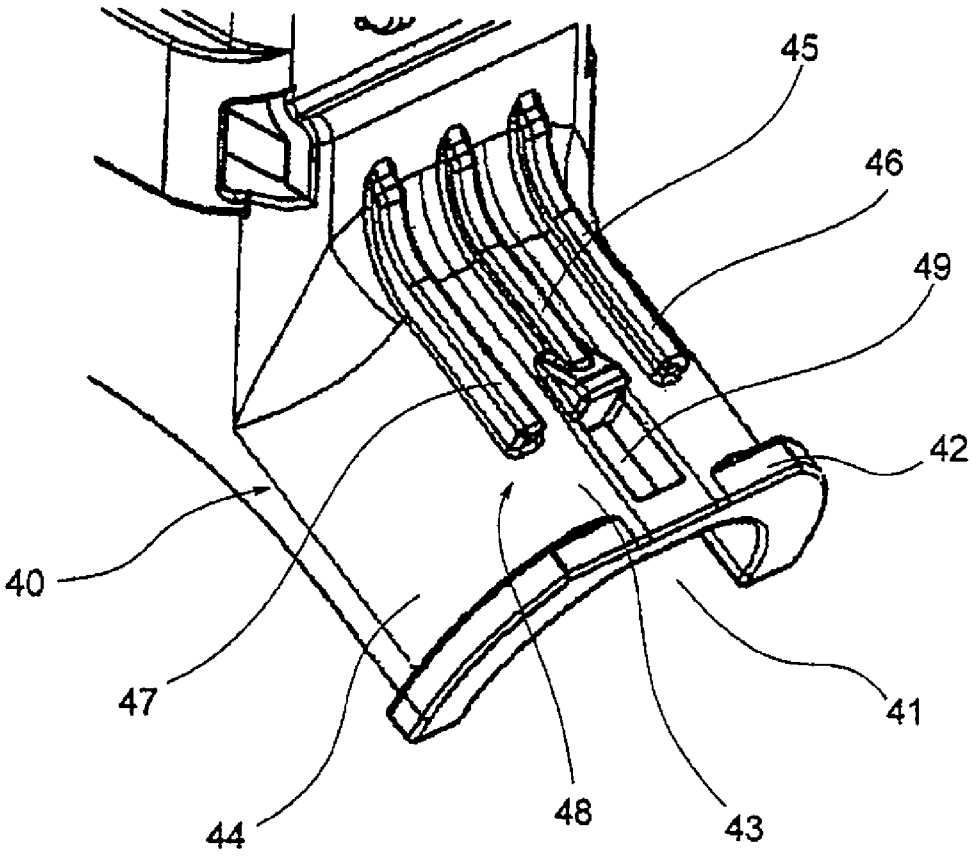
FIG. 2 is a fragmental enlarged perspective view showing such a state that a cover is removed from the connector shown in FIG. 1.
Figure 3:
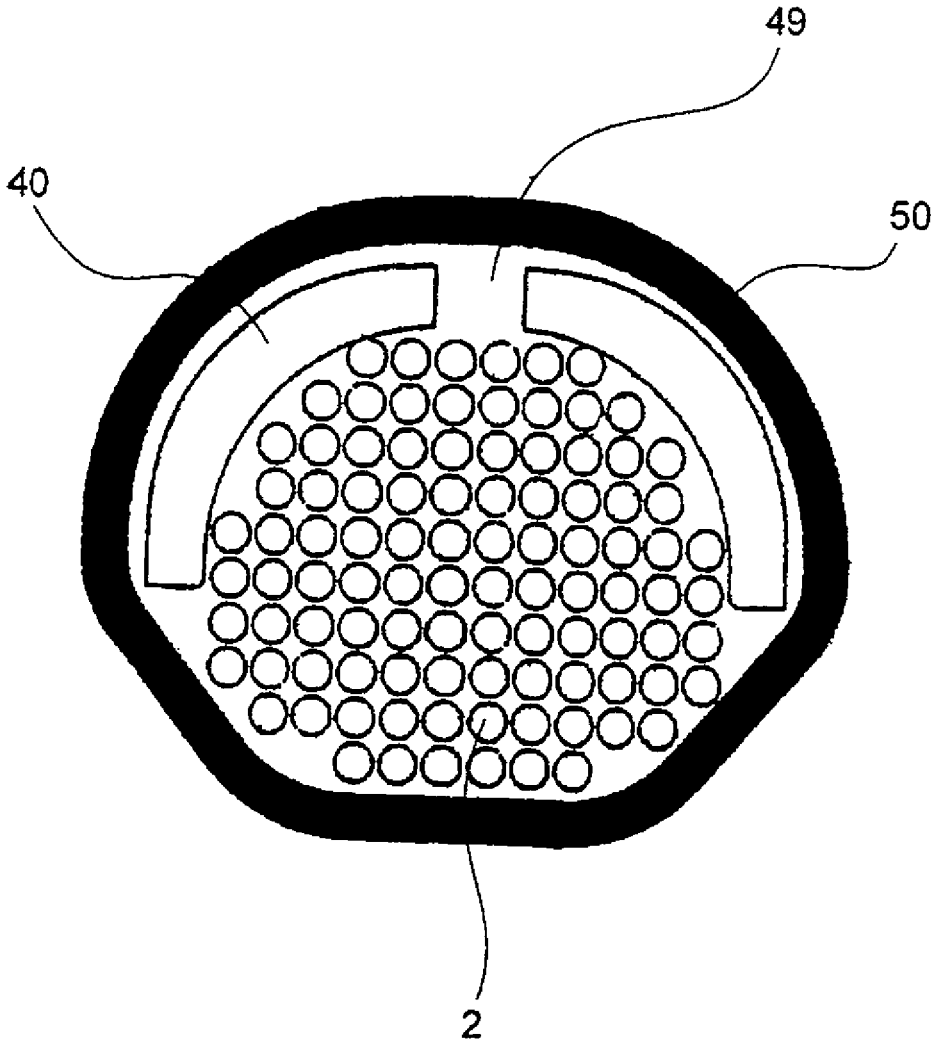
FIG. 3 is a view showing such a state that electric wires are wound and bound such that a binding band is not passed through a band passing hole in an electric wire fixing portion of the cover of the connector shown in FIG. 1.
Figure 4:
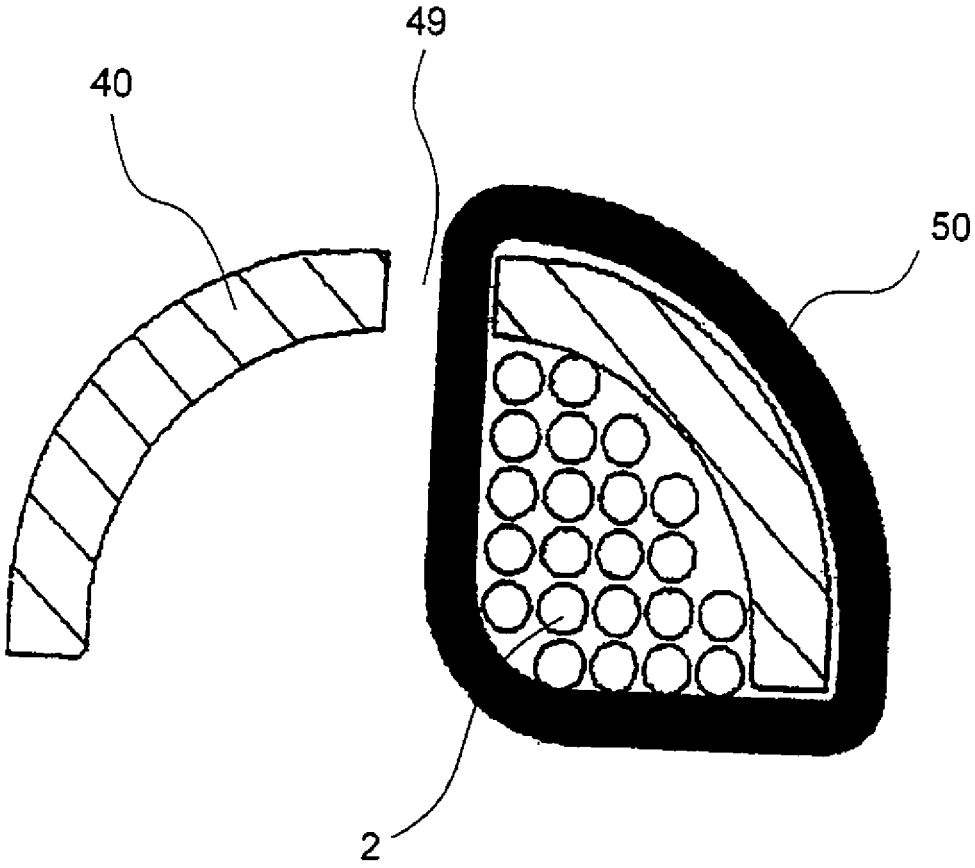
FIG. 4 is a view showing such a state that the electric wires are wound and bound on one side such that the binding band is passed through the band passing hole in the electric wire fixing portion of the cover of the connector shown in FIG. 1.
Figure 5:
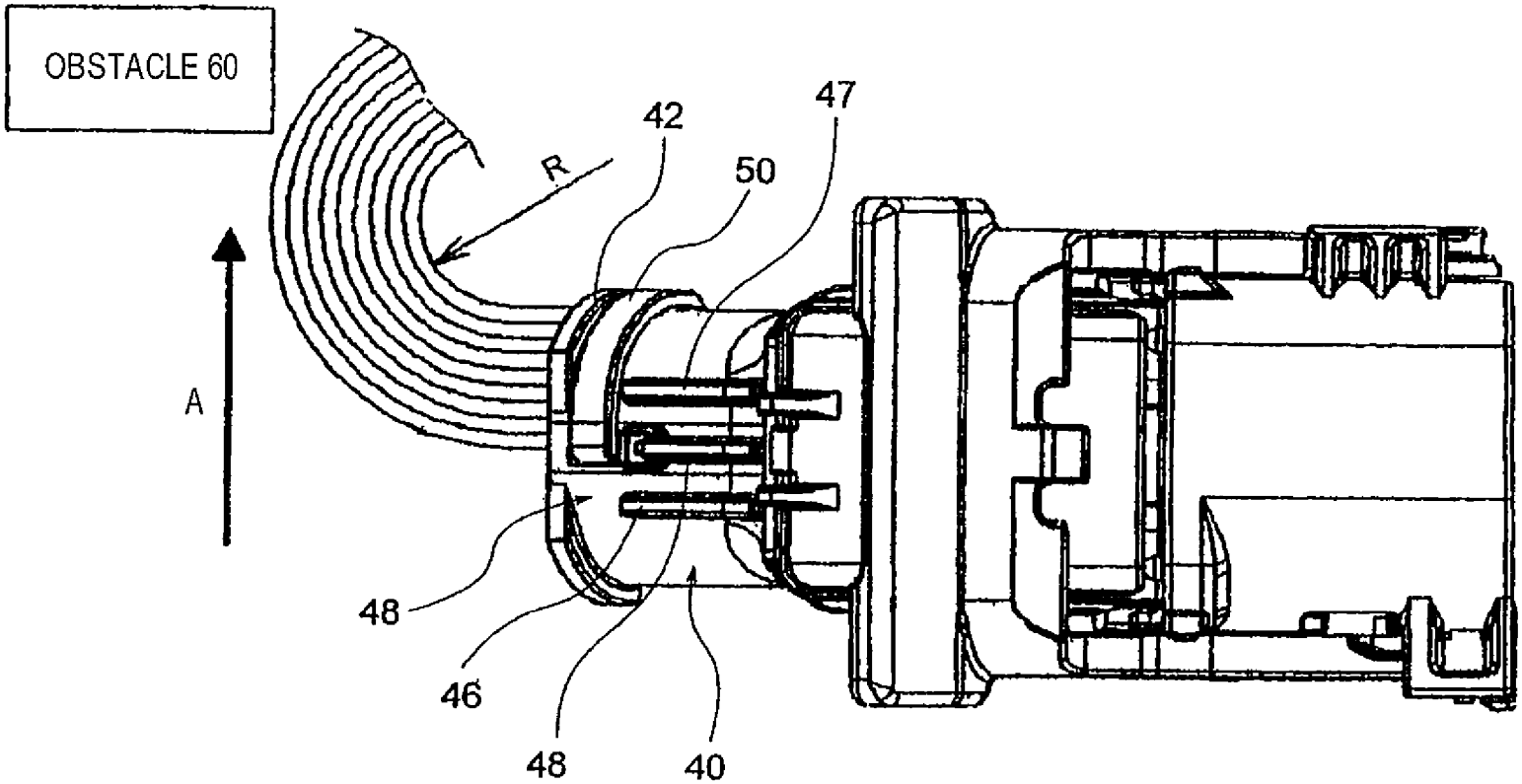
FIG. 5 is a view showing such a state that the electric wires are wound and bound on one side in a small radius of curvature R state to circumvent an obstacle such that the binding band is passed through the band passing hole in the electric wire fixing portion of the cover of the connector shown in FIG. 1.
Figure 6:
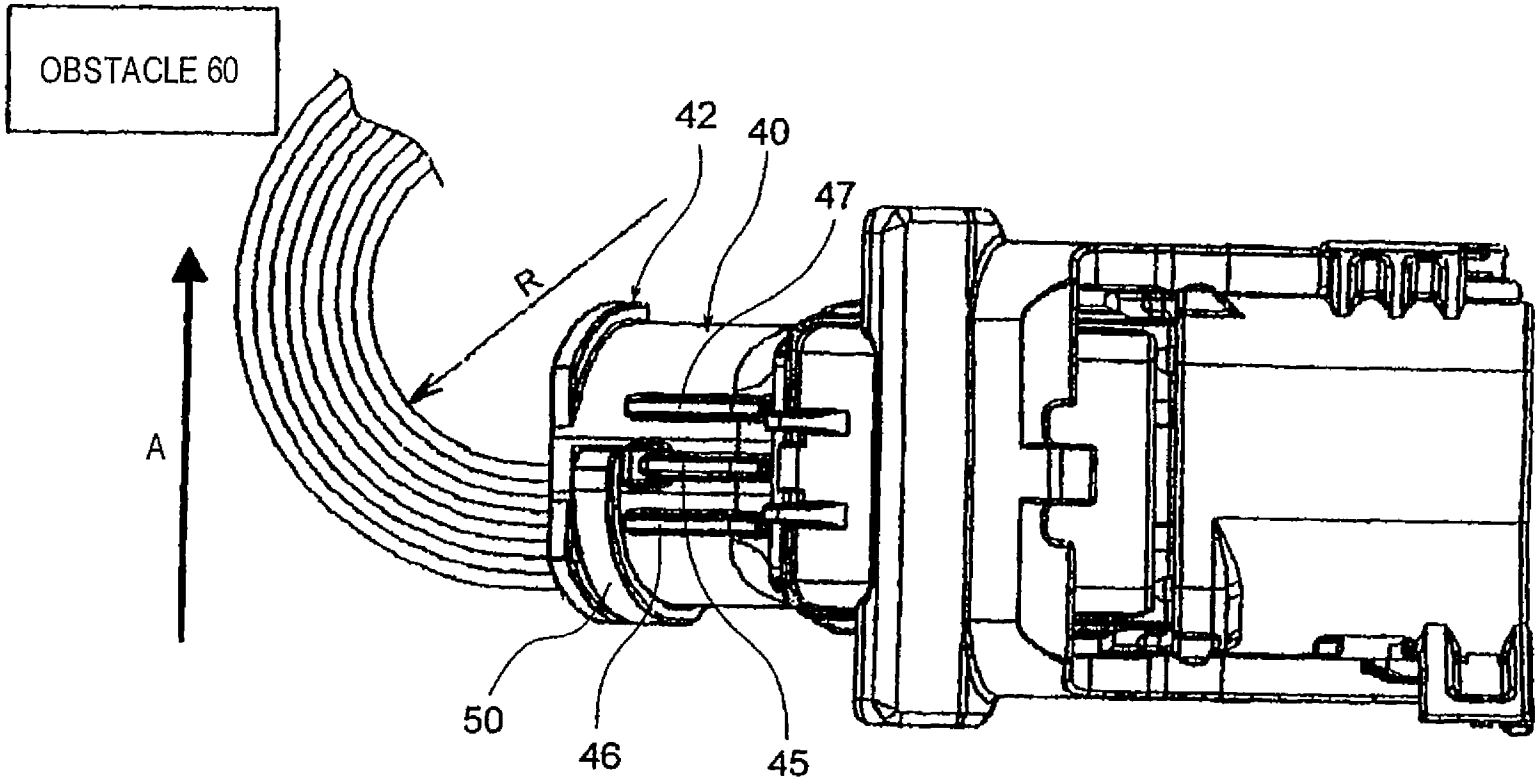
FIG. 6 is a view showing such a state that the electric wires are wound and bound on the other side in a large radius of curvature R state to circumvent the obstacle such that the binding band is passed through the band passing hole in the electric wire fixing portion of the cover of the connector shown in FIG. 1.
Figure 7:
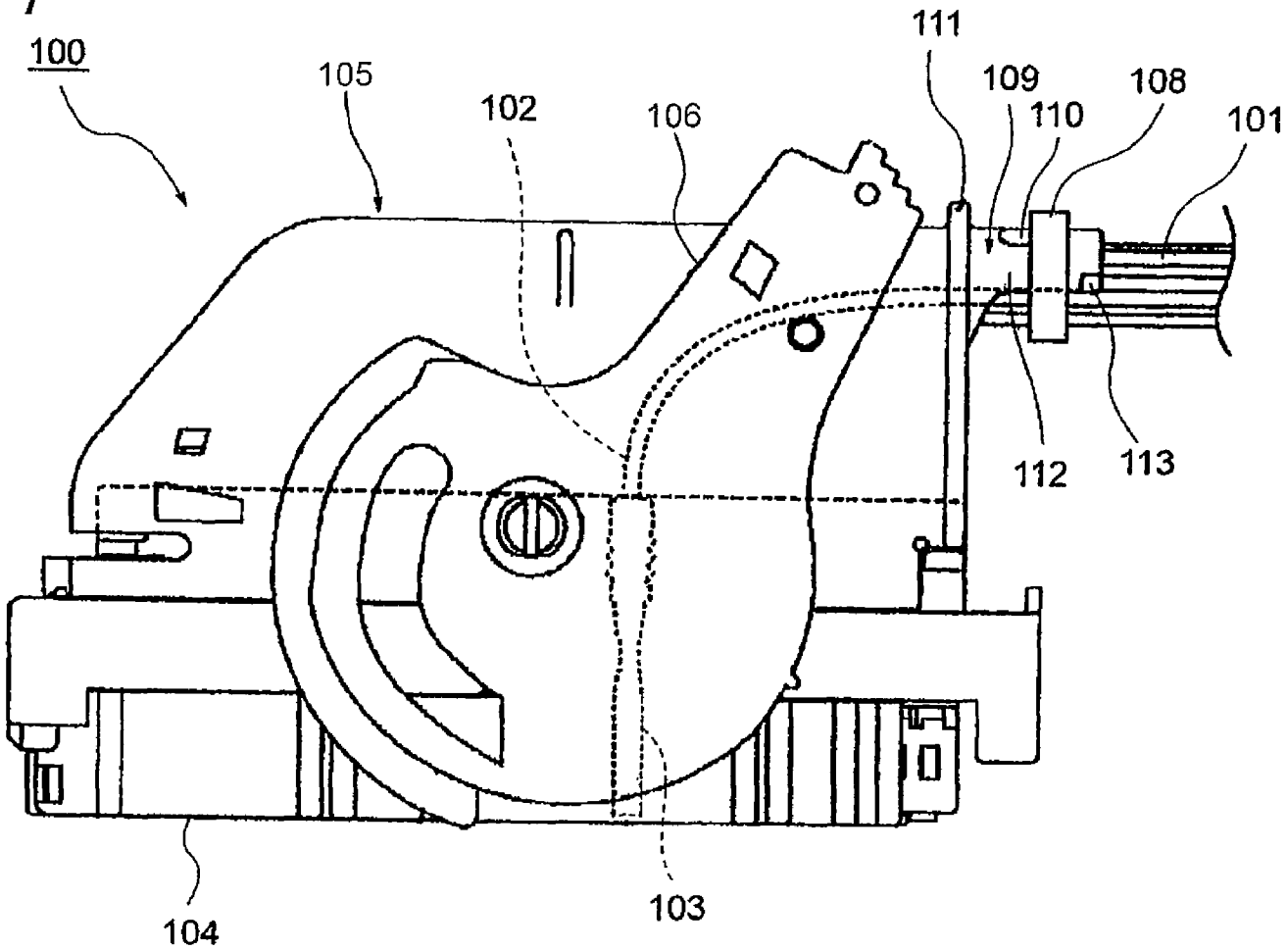
FIG. 7 is a side view showing a connector in the prior art.

An embodiment of the invention will be explained with reference to FIGS. 1 to 6 hereunder. FIG. 1 is a perspective view showing a connector according to an embodiment of the present invention when viewed from the cover side. FIG. 2 is a fragmental enlarged perspective view showing such a state that a cover is removed from the connector shown in FIG. 1. FIG. 3 is a view showing such a state that electric wires are wound and bound such that a binding band is not passed through a band passing hole in an electric wire fixing portion of the cover of the connector shown in FIG. 1. FIG. 4 is a view showing such a state that the electric wires are wound and bound on one side such that the binding band is passed through the band passing hole in the electric wire fixing portion of the cover of the connector shown in FIG. 1. FIG. 5 is a view showing such a state that the electric wires are wound and bound on one side in a small radius of curvature R state to circumvent an obstacle such that the binding band is passed through the band passing hole in the electric wire fixing portion of the cover of the connector shown in FIG. 1. FIG. 6 is a view showing such a state that the electric wires are wound and bound on the other side in a large radius of curvature R state to circumvent the obstacle such that the binding band is passed through the band passing hole in the electric wire fixing portion of the cover of the connector shown in FIG. 1. FIG. 7 is a side view showing a connector in the prior art.

In FIG. 1, a perspective view of the connector according to the present invention when viewed from the cover side is shown.

In FIG. 1, a connector 1 includes a connector housing 10 that is made of a synthetic resin and contains the terminals (not shown) that are connected to one end portions of electric wires 2 respectively. A pivot portion 11 is provided to both sides of the connector housing 10 respectively. This connector housing 10 is formed like a box shape that has terminal containing cells in which a plurality of terminals are contained correspondingly. Also, a cover 20 that is made of a synthetic resin is fitted to this connector housing 10 so as to lead the electric wires 2 being pulled out from the connector housing 10 to the outside while guiding the electric wires.

Also, a lever 30 is fitted to straddle this cover 20 in the width direction. This lever 30 is supported turnably on the pivot portions 11 that are provided to the connector housing 10.

The lever 30 enables an opposite connector housing (not shown) to be fitted into the connector housing 10 with a small inserting force. That is, the lever 30 is formed like a substantially gate shape whose plate-like arm portion 32 is extended from both ends of an operating portion 31 that extends in the lateral direction. The arm portions 32 located on both sides are fitted to the pivot portion 11 respectively, and the lever 30 is fitted to turn around the pivot portion 11.

When this lever 30 is operated to turn, the operation to fit the opposite connector housing into the connector housing 10 is assisted by the cam action.

The cover 20 is formed of synthetic resin material, and is formed like an almost box shape that is opened downward and rearward. An upper portion of the connector housing 10 is fitted into an opening portion of the cover 20 on the lower side. Thus, the cover 20 is attached in a state that it covers an upper area of the connector housing 10.

Also, an electric wire fixing portion 40 for fixing the electric wires 2 being pulled out from the connector housing 10 therein is formed at the back of the cover 20. An opening of the electric wire fixing portion 40, through which the electric wires 2 are extended, is formed as an electric wire leading port 41. This electric wire leading port 41 is shaped to lead the electric wire 2 being pulled out from the connector housing 10 to the outside while guiding these electric wires 2.

As shown in FIG. 2, the electric wire fixing portion 40 of the cover 20 is opened like an arch shape, and a flange portion 42 is formed at the electric wire leading port 41 as an opening end so as to protrude toward the outer periphery side. Also, an upper wall 43 and a pair of side walls 44 connected to right and left parts of the upper wall 43 are formed as an upper portion of the electric wire fixing portion 40 to have a substantial gate-like sectional shape or an arch-like sectional shape. Thus, an outer peripheral surface of the electric wire fixing portion 40 is constructed by the upper wall 43 and a pair of side walls 44 of the electric wire fixing portion 40.

A main rib 45 is formed in a center of the upper wall 43 of the electric wire fixing portion 40 to extend from a root portion of the electric wire fixing portion 40 in the longitudinal direction of the electric wire fixing portion 40. A binding band winding space 48 whose interval is set substantially equal to a width of a binding band 50 is provided to a end of the main rib 45 such that the binding band 50 for binding/fixing the electric wires 2 can be wound between the end of the main rib 45 and the flange portion 42.

Also, at least two side ribs 46, 47 are provided on both sides of the main rib 45 provided in the middle of the upper wall 43 of the electric wire fixing portion 40. The number of the side ribs 46, 47 provided on both sides of the main rib 45 is not always limited to two, and any plural number that is in excess of two may be employed.

The main rib 45 and the side ribs 46, 47 have an effect to increase the strength of the electric wire fixing portion 40.

Also, like the main rib 45, the binding band winding space 48 whose interval is set substantially equal to the width of the binding band 50 is also provided to ends of the side ribs 46, 47 such that the binding band 50 for binding/fixing the electric wires 2 can be wound between the ends of the side ribs 46, 47 and the flange portion 42.

Also, a band passing hole 49, through which the binding band 50 is passed between the end of the main rib 45 and the flange portion 42, is provided in the upper wall 43 of the electric wire fixing portion 40 on which the binding band winding space 48 is formed between the main rib 45 and the flange portion 42.

Also, the band passing hole 49 is formed like a slit shape in a center of the electric wire fixing portion 40 on a prolonged line of the main rib 45 in the longitudinal direction. This band passing hole 49 is provided such that the binding band 50 is passed through this hole from the upper wall 43 side of the electric wire fixing portion 40 to the inner wall surface of the electric wire fixing portion 40.

The binding band 50 is formed like a strip shape. This binding band 50 is wound on the binding band winding space 48 formed between the ends of the main rib 45 and the side ribs 46, 47 on the electric wire fixing portion 40 and the flange portion 42. The binding band 50 is used to bind/fix the electric wires 2 that are extended from the connector housing 10.

When the binding band 50 is wound on the binding band winding space 48 of the electric wire fixing portion 40 not to pass through the band passing hole 49, a movement of the wound binding band 50 in the longitudinal direction of the electric wire fixing portion 40 is restricted by the ends of the main rib 45 and the side ribs 46, 47 and the flange portion 42.

An action of the connector according to the present invention constructed in this manner will be explained with reference to FIGS. 3 to 6 hereunder.

When the electric wires 2 extended from the connector housing 10 are bound/fixed in the cover 20, as shown in FIG. 3, the binding band 50 is wound on the electric wires 2 and the electric wire fixing portion 40 to fasten, while pushing the bundle of the electric wires 2 against the inner wall surface of the electric wire fixing portion 40. An example in FIG. 3 shows the case where the number of the electric wires 2 being bound/fixed by the cover 20 is large and the binding band 50 is not passed through the band passing hole 49.

When the number of the electric wires 2 being bound and fixed by the cover 20 is small, as shown in FIG. 4, the bundle of the electric wires 2 extended from the connector housing 10 is pushed against one inner wall surface of the electric wire fixing portion 40 with respect to a center of the band passing hole 49, and then the bundle of the electric wires 2 is fastened by winding the binding band 50 on the electric wire fixing portion 40 to pass through the band passing hole 49.

Since the binding band 50 is wound to pass through the band passing hole 49 in this manner, the bundle of the electric wires 2 can be bound/fixed such that the bundle of the electric wires 2 is pushed against either of left and right inner wall surface of the electric wire fixing portion 40 with respect to the center of the band passing hole 49.

As shown in FIGS. 5 and 6, for example, in the situation that the binding band 50 is wound to pass through the band passing hole 49, the user can select which the electric wires 2 is pushed against either of left and right inner sides of the electric wire fixing portion 40 with respect to the center of the band passing hole 49 when an obstacle 60 exists in vicinity of the electric wire leading port 41 of the electric wire fixing portion 40. In FIGS. 5 and 6, the electric wire is bended in a direction shown by an arrow A.

That is, the case shown in FIG. 5 illustrates the case where a radius of curvature R of the bundle of the electric wires 2 is set small such that this bundle of the electric wires 2 being extended from the connector housing 10 can circumvent this obstacle 60. Also, the case shown in FIG. 6 illustrates the case where the radius of curvature R of the bundle of the electric wires 2 is set large such that this bundle of the electric wires 2 being extended from the connector housing 10 can circumvent this obstacle 60.

In this manner, when the bundle of the electric wires 2 is bound and fixed on the electric wire fixing portion 40, along which the binding band 50 is passed through the band passing hole 49 and wound, can be selected in response to the number or the outer diameter of the electric wires 2 to be fixed. Thus, the electric wires 2 can be fixed tightly to the electric wire fixing portion 40. Also, the arrangement that the band passing hole 49 is arranged in the middle of the electric wire fixing portion 40 makes it possible to select the fixing method in response to the number of electric wires and to change the fixing direction according to on the surrounding environment.

Further, when the obstacle 60 exists in vicinity of the electric wire leading port 41 of the electric wire fixing portion 40, the bundle of the electric wires 2 must be curved to circumvent this obstacle 60. At this time, the radius of curvature R of the bundle of the electric wires 2 can be set large, while considering a stress applied to the curved portion, by fixing the bundle of the electric wires 2 in the position of the electric wire fixing portion 40 located oppositely to the direction A, as shown in FIG. 6. Therefore, the radius of curvature R of the bundle of the electric wires 2 can be set large, and also a stress applied to the bundle of the electric wires 2 can be lessened.

According to the embodiment of the connector 1, the situation that the electric wires 2 are nicked by the binding band 50 can be prevented by preventing a displacement of the binding band 50. Also, the strength of the electric wire fixing portion 40 can be increased by the main rib 45 and the side ribs 46, 47.

Also, according to the embodiment of the connector 1 according to the present invention, the band passing hole 49 is arranged in the middle of the electric wire fixing portion 40. Therefore, the fixing method can be selected in accordance with the number of the electric wires 2, and also the fixing method for the bundle of the electric wires can be selected according to on the surrounding environment. As a result, a stress applied to the electric wires 2 can be lessened, and also a break of the electric wires 2 can be prevented.

The present application is based on Japanese Patent Application No. 2010-162458 filed on Jul. 20, 2010, the contents of which are incorporated herein by way of reference.

INDUSTRIAL APPLICABILITY

The present invention is extremely useful in providing a connector that is able to prevent the electric wire being damaged.

REFERENCE SIGNS LIST

1 connector
2 electric wire
10 connector housing
20 cover
30 lever
40 electric wire fixing portion
41 electric wire leading port
42 flange portion
43 upper wall
44 a pair of side walls
45 main rib
46 side rib
47 side rib
48 binding band winding space
49 band passing hole
50 binding band
60 obstacle

What is claimed is:

1. A connector, comprising:

a connector housing, configured to accommodate a terminal connected to an end of an electric wire;

a cover, attached to the connector housing, and configured to lead the electric wire from the connector housing to an outside;

an electric wire fixing portion, provided at an electric wire leading port formed in the cover where the electric wire is led out;

a flange portion, provided at an end portion of the electric wire fixing portion where the electric wire is pulled out from the connector housing;

a rib, separate from a covering of the electric wire, provided on an outer surface of the electric wire fixing portion, extending in a longitudinal direction of the electric wire fixing portion at a center thereof;

a binding band winding space, provided between an end of the rib and the flange portion, and interval therebetween having a width equal to a width of a binding band, wherein the electric wire is fixed by the binding band wound on the binding band winding space;

a band passing hole, formed between the end of the rib and the flange portion, configured so that the binding band is inserted therethrough; and a plurality of side ribs, separate from the covering of the electric wire, symmetrically provided at both sides of the rib, wherein, when the electric wire is fixed in the electric wire fixing portion by the binding band, the binding band is inserted through the band passing hole, in response to a volume of the electric wire or in response to a size of a radius of curvature of the electric wire led out from the connector housing.

2. The connector according to claim 1, wherein the band passing hole is a slit provided at a center of the binding band winding space on a prolonged line of the rib, the slit extending in the longitudinal direction of the electric wire fixing portion.

3. The connector according to claim 1, wherein the rib and the flange portion are walls of the binding band winding space configured to restrict a movement of the binding band in the longitudinal direction of the electric wire fixing portion.

4. The connector according to claim 1, wherein each of said plurality of side ribs respectively extends both parallel to said rib and perpendicular to a longitudinal direction of the binding band.

5. The connector according to claim 1, wherein the a binding band winding space is defined by a binding band winding housing configured to house the binding band such that a width of the binding band winding housing and a width of the binding band are equal.

6. The connector according to claim 1, wherein the plurality of side ribs are provided on the outer surface of the electric wire fixing portion.

7. The connector according to claim 1, wherein the rib and the side ribs have substantially similar shapes.

8. The connector according to claim 1, wherein the rib and the side ribs are formed on a same surface of the electric wire fixing portion.

9. The connector according to claim 1, wherein the side ribs are rectangular-shaped.

10. The connector according to claim 1, wherein the rib and the side ribs are substantially equal in length.

11. A connector, comprising:

a connector housing, configured to accommodate a terminal connected to an end of an electric wire;

a cover, attached to the connector housing, and configured to lead the electric wire from the connector housing to an outside;

an electric wire fixing portion, provided at an electric wire leading port formed in the cover where the electric wire is led out;

a flange portion, provided at an end portion of the electric wire fixing portion where the electric wire is pulled out from the connector housing;

a rib, separate from a covering of the electric wire, provided on an outer surface of the electric wire fixing portion, extending in a longitudinal direction of the electric wire fixing portion at a center thereof;

a binding band winding space, provided between an end of the rib and the flange portion, and interval therebetween having a width equal to a width of a binding band, wherein the electric wire is fixed by the binding band wound on the binding band winding space;

a band passing hole, formed between the end of the rib and the flange portion, configured so that the binding band is inserted therethrough; and a plurality of side ribs, separate from the covering of the electric wire, symmetrically provided at both sides of the rib, wherein, when the electric wire is fixed in the electric wire fixing portion by the binding band, the binding band is inserted through the band passing hole, in response to a volume of the electric wire or in response to a size of a radius of curvature of the electric wire led out from the connector housing, and the band passing hole is a slit provided at a center of the binding band winding space on a prolonged line of the rib, the slit extending in the longitudinal direction of the electric wire fixing portion.

* * * * *